US010272590B2

(12) United States Patent
Zorn

(10) Patent No.: US 10,272,590 B2
(45) Date of Patent: Apr. 30, 2019

(54) PICKUP AND ALIGNMENT MECHANISM FOR LOGS AND A METHOD OF USE

(71) Applicant: Gary Lee Zorn, Porterfield, WI (US)

(72) Inventor: Gary Lee Zorn, Porterfield, WI (US)

( * ) Notice: Subject to any disclaimer, the term of this patent is extended or adjusted under 35 U.S.C. 154(b) by 871 days.

(21) Appl. No.: 14/713,679

(22) Filed: May 15, 2015

(65) Prior Publication Data

US 2015/0343661 A1 Dec. 3, 2015

Related U.S. Application Data

(60) Provisional application No. 62/005,056, filed on May 30, 2014.

(51) Int. Cl.
*B27B 17/00* (2006.01)
*B27B 31/00* (2006.01)

(52) U.S. Cl.
CPC ..... *B27B 17/0058* (2013.01); *B27B 17/0091* (2013.01); *B27B 31/00* (2013.01); *Y10T 29/50* (2015.01); *Y10T 83/7108* (2015.04)

(58) Field of Classification Search
CPC .... A01G 23/00; A01G 23/003; A01G 23/006; A01G 23/08; A01G 23/091
USPC ..... 83/803–808, 213, 214, 471.1, 519; 414/910, 911, 745.1–746.8
See application file for complete search history.

(56) References Cited

U.S. PATENT DOCUMENTS 2,522,814 A 9/1950 Clary
3,078,886 A 2/1963 Childress
3,455,477 A 7/1969 Blair
3,512,665 A 5/1970 Westendorf
3,517,711 A 6/1970 Reeser et al.
3,817,567 A * 6/1974 Lull ..... B66F 9/18 294/104
4,005,625 A * 2/1977 Brochu ..... B23D 57/026 83/100
4,049,140 A 9/1977 Roose
4,421,449 A 12/1983 Cotton
4,459,080 A 7/1984 Walter et al.
4,529,239 A 7/1985 Ogawa
5,476,356 A * 12/1995 Weiss ..... A01D 87/0053 414/24.5
6,065,926 A 5/2000 Knapp
6,776,571 B2 8/2004 Riffle
7,478,490 B2 1/2009 Segerljung
8,585,344 B2 * 11/2013 Sharp ..... B66F 9/142 187/237

(Continued)

*Primary Examiner* — Matthew Katcoff
(74) *Attorney, Agent, or Firm* — Northwind IP Law, S.C.; Thomas J. Connelly

(57) ABSTRACT

A pickup and alignment mechanism for logs is disclosed along with a method of using the mechanism. The pickup and alignment mechanism includes a frame, a connector and a plurality of L-shaped tines secured to the frame. The plurality of L-shaped tines is grouped into pairs. The pickup and alignment mechanism also includes a pair of side tines. The pickup and alignment mechanism is designed to be removably mounted to a motorized vehicle. All of the L-shaped tines can be hydraulically or pneumatically actuated to remove from between one to six logs from a stacked pile of logs. The one to six logs are then raised above ground level and are aligned relative to one another so that they can be easily cut into smaller piece of firewood by a person with a chain saw.

20 Claims, 6 Drawing Sheets

(56) References Cited

U.S. PATENT DOCUMENTS

2009/0008951 A1* 1/2009 Whetstine ..... H01L 21/84
293/120
2009/0116945 A1* 5/2009 White ..... B66F 9/12
414/667

* cited by examiner

PICKUP AND ALIGNMENT MECHANISM FOR LOGS AND A METHOD OF USE

CROSS REFERENCE TO RELATED APPLICATION

This application claims priority as a Non-provisional application to Provisional application U.S. Ser. No. 62/005,056 filed May 30, 2014.

FIELD OF THE INVENTION

This invention relates to a pickup and alignment mechanism for logs and a method of using said mechanism.

BACKGROUND OF THE INVENTION

In many states trees are harvested for firewood. The trees are cut in the forest by loggers. The branches are removed from the down tree and then the trunk of the tree is cut into approximately 100 inch lengths (8.3 feet). The approximately 100 inch long logs are stacked on a logging truck and transported to customers who order firewood. Farmers, cottage owners, small businesses, etc. buy a truck load, about 200 or more such logs, at a time. These logs are stacked on the ground, essentially parallel to one another, forming an approximately triangular shaped pile. The customer is responsible for cutting each log into smaller pieces of firewood, having lengths of from 16 inches to about 25 inches or longer, that can be burned in a wood burning furnace, stove, fireplace, camp fire, etc. If the diameter of each log is large, each piece of firewood can be split using a hydraulic wood splitter, an axe or some other device. However, most wood burning furnaces today are designed to receive a cylindrically shaped log having a diameter of up to about 25 inches without the need to first split the log.

For those people who burn a large quantity of wood in a season, it takes time to cut each log and stack the pieces of wood in a desired location. Normally, the log cutting is accomplished by a sole person who does not have a helper. The log cutting is physical work requiring cutting, lifting and stacking of the cut pieces of wood. In a typical setup, the outermost log, located at the bottom and side of the stack of logs is generally cut first. This means that as the log is cut with a chain saw, the blade of the chain saw may contact the dirt or ground as the three, four or five cuts are made to each approximately 100 inch log. Four or more pieces of firewood can be obtained from each 100 inch long log. The contact of the blade of the chain saw with the ground will eventually cause the blade to become dual. A dual blade has to be resharpened, a time consuming process. In addition, if the blade of the chain saw hits a rock, the blade can be damaged. Furthermore, the chain saw operator is required to bend over so as to cut each log in three or more places at ground level in order to obtain the required lengths. This need to bend over can cause back pain after an extended period of time. Lastly, the cut firewood has to be manually lifted and stacked in a desired location. This is hard physical labor that can tax an older person or a person suffering from some kind of health problem.

Another option is for two people to lift each log above ground level and place it on two or more supports. The 100 inch long log can then be cut into four or more separate pieces of firewood without worrying about the blade of the chain saw contacting the ground. However, two people are not always available.

Now, a pickup and alignment mechanism for logs has been invented along with a method of using the mechanism. This pickup and alignment mechanism automates the cutting, lifting and transporting process and reduces the physical exertion mentioned above. This pickup and alignment mechanism can be used by a person who actually burns the firewood or by a handy man that has been hired to cut the entire stack of logs.

SUMMARY OF THE INVENTION

Briefly, this invention relates to a pickup and alignment mechanism for logs and a method of use. The pickup and alignment mechanism can be physically attached and connected, hydraulically or pneumatically, to a motorized vehicle. The pickup and alignment mechanism includes a frame having a first rail, a second rail and a face plate. The first rail is spaced apart from the second rail. The first and second rails each have a first end and a second end. The face plate connects the first and second rails together. The face plate has an upper edge positioned adjacent to the first rail and a lower edge positioned adjacent to the second rail. A connector on the motorized vehicle is secured to the face plate and allows the pickup and attachment mechanism to be physically attached to the motorized vehicle. The face plate includes a first abutment point located adjacent to the upper edge of the face plate, and second and third spaced apart attachment points located adjacent to the lower edge of the face plate. The first point is also located approximately midway between the second and third attachment points.

The pickup and alignment mechanism also includes a plurality of L-shaped tines. Each of the plurality of L-shaped tines is an integral member having a horizontal portion aligned approximately perpendicular to a vertical portion. Each of the vertical portions is secured to at least one, if not both, of the first and second rails. The pickup and alignment mechanism further includes a pair of side tines connected to a cylinder which can be actuated to simultaneously or sequentially move the pair of side tines towards or away from one another. One of the pair of side tines is positioned adjacent to the first end of the second rail and the other pair of side tines is positioned adjacent to the second end of the second rail. A hydraulic or pneumatic hose is connected between the motorized vehicle and the cylinder for supplying pressurized fluid or air to actuate the cylinder. Lastly, the pickup and alignment mechanism includes a plurality of bumpers, each positioned between one of the pairs of L-shaped tines. Each of the bumpers is secured to the vertical portions of each of the pairs of the L-shaped tines. Each of the bumpers is spaced apart from an adjacent bumper. The bumpers provide clearance such that a person with a saw can cut the logs positioned on the plurality of L-shaped tines without worrying about contacting the first and second rails or the face plate with the blade of the saw and damaging it.

The plurality of L-shaped tines can be maneuvered to pickup from between one to six logs at a time and raise the logs a desired distance off the ground. The one to six logs are aligned in a single row on the L-shaped tines. The pair of side tines functions to longitudinally align the logs relative to one another so that they can be cut to a desired length by a person with a saw.

An alternative pickup and alignment mechanism is also taught which utilizes a plurality of chain saws which are pivotably mounted to the frame. The chain saws can be sequentially activated so as to make cuts through all of the logs positioned on the plurality of L-shaped tines. The logs can be arranged in a three-sided configuration on the L-shaped tines. Both of these pickup and alignment mechanisms are easy to operate, save time and provide an efficient way of cutting firewood.

The general object of this invention is to provide a pickup and alignment mechanism for logs. A more specific object of this invention is to provide a pickup and alignment mechanism that can be removably mounted to the front end of a tractor, a utility tractor, a Bobcat, a skid steer loader or some other kind of motorized vehicle, and pick up and align from one to six logs so that they can be easily cut by a person with a chain saw, above ground level, before being transported to a designated storage location.

Another object of this invention is to provide a pickup and alignment mechanism which can easily and quickly be mounted to a motorized vehicle.

Still another object of this invention is to provide a pickup and alignment mechanism which can be utilized by a sole person.

A further object of this invention is to provide a method of picking up and aligning from one to six, approximately 100 inch long, logs and then raising the logs above ground level so that they can be easily cut.

Still further, an object of this invention is to provide a method of transporting multiple pieces of cut firewood to a storage location using the pickup and alignment mechanism.

Other objects and advantages of the present invention will become more apparent to those skilled in the art in view of the following description and the accompanying drawings.

DETAILED DESCRIPTION OF THE INVENTION

Figure 1:
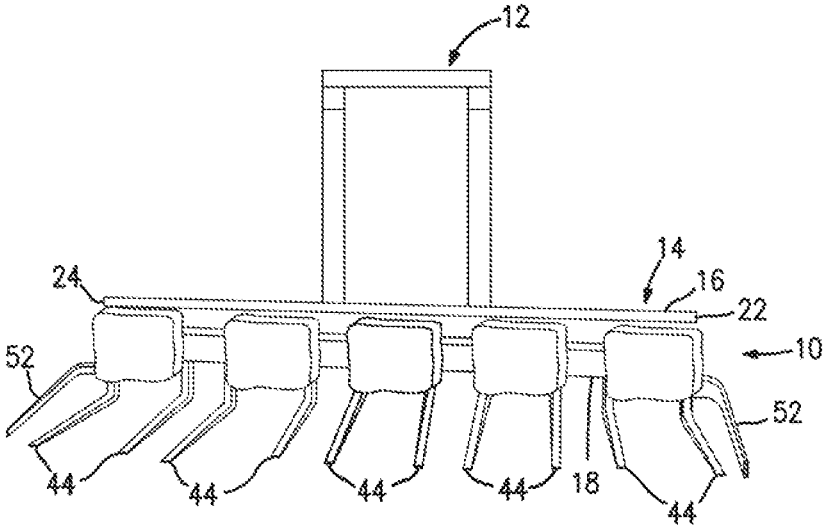
FIG. 1 is a schematic view of the pickup and alignment mechanism for logs attached to the front end of a motorized vehicle.

Referring to FIG. 1, a pickup and alignment mechanism for logs 10 is shown. The pickup and alignment mechanism for logs 10 is physically attached and connected to a motorized vehicle 12. The connection can be by hydraulics, pneumatics, or some other method known to those skilled in the art. A hydraulic connection is most common. The motorized vehicle 12 can be any type of vehicle. The motorized vehicle 12 could be a tractor having wheels or tracks, a utility tractor, a Bobcat®, a skid steer loader, etc. The pickup and alignment mechanism for logs 10 is shown being connected to the front of the motorized vehicle 12.

Figure 4:
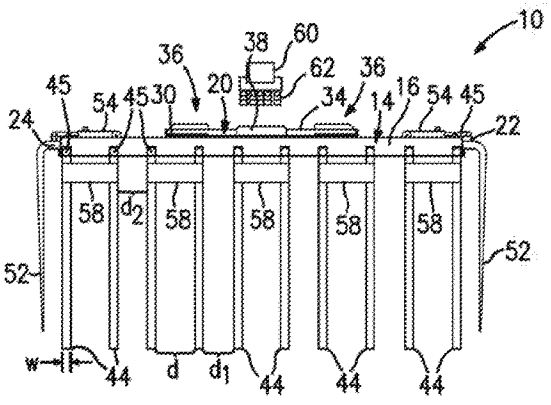
FIG. 4 is a top view of the pickup and alignment mechanism shown in FIG. 1.
Figure 2:
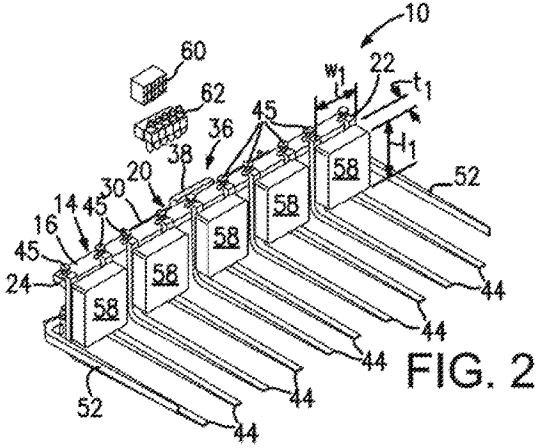
FIG. 2 is a front isometric view of the pickup and alignment mechanism shown in FIG. 1.
Figure 3:
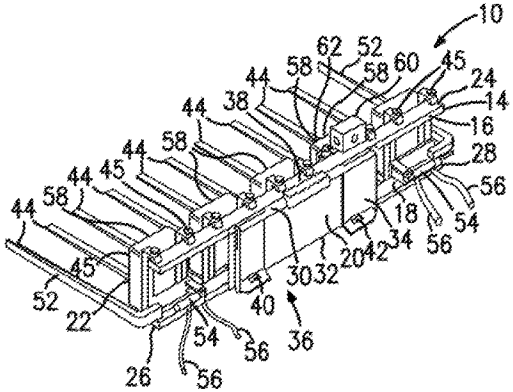
FIG. 3 is a rear isometric view of the pickup and alignment mechanism shown in FIG. 1.

Referring to FIGS. 2-4, the pickup and alignment mechanism for logs 10 includes a frame 14. The frame 14 has a first rail 16, a second rail 18 and a face plate 20. The first rail 16 is spaced apart from the second rail 18. Desirably, the first rail 16 is located vertically above and away from the second rail 18. The distance the first rail 16 is spaced apart from the second rail 18 can vary. The distance can be about 36 inches or less. Desirably, the distance is about 30 inches or less. The first rail 16 has a first end 22 and a second end 24. Likewise, the second rail 18 has a first end 26 and a second end 28, see FIG. 3. The first and second rails, 16 and 18 respectively, can be solid members or be hollow members. For example, the first and second rails, 16 and 18 respectively, can be hollow tubular members. The cross-sectional shape of the first and second rails, 16 and 18 respectively, can vary. The first and second rails. 16 and 18 respectively, can be circular, square, rectangular, triangular, etc. in shape. The first and second rails, 16 and 18 respectively, are depicted as elongated members having rectangular cross-sections with rounded corners.

The face plate 20 connects or joins the first rail 16 to the second rail 18. The face plate 20 has an upper edge 30 positioned adjacent to the first rail 16 and a lower edge 32, see FIG. 3, positioned adjacent to the second rail 18. The face plate 20 also has a rear surface 34, see FIGS. 3 and 4.

The first rail 16, the second rail 18 and the face plate 20 can be constructed from various materials. Desirably, the first rail 16, the second rail 18 and the face plate 20 are all constructed out the same material. The first rail 16, the second rail 18 and the face plate 20 can be formed from steel, a steel alloy, metal, a metal alloy, etc. Steel is a preferred material for the first and second rails, 16 and 18 respectively, and for the face plate 20 because it is durable, malleable and is not susceptible to breaking.

Referring to FIG. 3, the pickup and alignment mechanism for logs 10 also includes a connector 36 secured to the face plate 20. Desirably, the connector 36 is located on a rear surface 34 of the face plate 20. The connector 36 allows the pickup and attachment mechanism for logs 10 to be physically attached to the motorized vehicle 12. The connector 36 including a first abutment point 38 located adjacent to the upper edge 30 of the face plate 20, and second and third attachment points, 40 and 42 respectively. The second and third attachment points, 40 and 42 respectively, are spaced apart from one another and are located adjacent to the lower edge 32 of the face plate 20. The first abutment point 38 is located approximately midway between the second and third attachment points, 40 and 42 respectively. The connector 36 is a quick attachment that is well known in the art.

As depicted in FIG. 3, the first abutment point 38 is depicted as an abutment surface that can be contacted by a flat member located on or extending forward from the front end of a tractor. The second and third attachment points, 40 and 42 respectively, are depicted as apertures. Each of the apertures 40 and 42 can receive a tongue, a hook, an arm, etc. For example, the two forward extending hydraulic arms on a utility tractor can engage with the second and third attachment points, 40 and 42 respectively. Those skilled in the art will be well aware of other kinds of connectors that can be used instead of the connector 36 described above.

Most implements which are designed to be removably connected to tractors having wheels or tracks, a utility tractor, Bobcats®, skid steer loaders, etc. utilize some kind of a face plate. The face plate is designed to be engaged by the two forwardly extending arms protruding out from the motorized vehicle. In addition, some agricultural, industrial and construction vehicles utilize a connector plate that is attached to the two forwardly extending arms and in turn engage with the face plate 20. Such connector plates usually abut against the first abutment point 38. Hydraulic or pneumatic hoses can be connected to the implement to raise, lower and/or maneuver the implement once it is attached to the motorized vehicle 12. Hydraulic and pneumatic cylinders, hoses, controls, pumps, reservoirs, fluid or air supply tanks, etc. are all well known to those skilled in the art.

Referring to FIGS. 1-5, the pickup and alignment mechanism for logs 10 further includes a plurality of tines 44. Each tine 44 is an integral member. By "tine" it is meant a prong on an implement such as a fork or pitchfork. Desirably, two, three, four, five, six, seven, eight, nine, ten or more tines 44 are utilized. More desirably, an even number of tines 44, 44 are utilized. The tines 44 can vary in size, shape and configuration. For example, each tine 44 can be a horizontal member having a predetermined geometrical cross-section. The cross-section can vary. The cross-section can be square, rectangular, circular, a hollow tube, etc. Each tine 44 can be removably or permanently secured to the frame 14 using mechanical fasteners or by welding.

Desirably, each tine 44 has an L-shaped configuration. Each L-shaped tine 44 has a horizontal portion 46 aligned approximately perpendicular, approximately 90 degrees, to a vertical portion 48, see FIG. 5. The vertical portion 48 of each L-shaped tine 44 can be secured to at least one, and preferably both, of the first and second rails, 16 and 18 respectively. Desirably, each of the plurality of L-shaped tines 44 is movably secured to the first and second rails, 16 and 18 respectively. Alternatively, each of the plurality of L-shaped tines 44 can be permanently secured to at least one, and preferably both, of the first and second rails, 16 and 18 respectively. Each of the plurality of L-shaped tines 44 can be movably secured in a number of ways known to those skilled in the art. For example, one could use mechanical fasteners, notches, apertures, clips, bolts, nuts, etc. to secure each of the plurality of L-shaped tines 44 to the frame 14.

Alternatively, the vertical portion 48 of each of the plurality of L-shaped tines 44 can be permanently or be movably secured to the first or the second rails, 16 or 18 respectively. Desirably, the vertical portion 48 of each of the plurality of L-shaped tines 44 is movably secured to at least one of the first and second rails, 16 and 18 respectively, by using some form of mechanical fastener. The mechanical fastener can vary. For example, the mechanical fastener can be, but is not limited to: nuts, wing nuts, bolts, pins, rotatable knobs, brackets, notches, slots, grooves, apertures, etc.

The plurality of L-shaped tines 44 can be formed from various materials. Each of the plurality of L-shaped tines 44 can be constructed from steel, a steel alloy, metal, a metal alloy, or from some other material known to those skilled in the art. Desirably, all of the L-shaped tines 44 are formed from the same material.

All of the L-shaped tines 44 can be constructed to the same dimensions. Alternatively, some of the L-shaped tines 44 can be of a different dimension, if desirous. Desirably, all of the L-shaped tines 44 are identical in shape and size and one can be substituted for another. The actual dimensions of an L-shaped tine 44 can vary. The horizontal portion of each L-shaped tine 44 has a height h, see FIG. 5, and a width w, and see FIG. 4. The height h can vary and does not have to be constant along the length of the horizontal portion 46. Desirably, the height h will be about 2 inches at its maximum dimension adjacent to the vertical portion 48. The width w of each L-shaped tine 44 can also vary. Desirably, the width w of each L-shaped tine 44 is at least about 2 inches. More desirably, the width w of each L-shaped tine 44 ranges from between about 2 inches to about 4 inches. More desirably, the width w of each L-shaped tine 44 ranges from between about 2 inches to about 3 inches. Typically, the width w dimension is constant along the length l of the horizontal portion 46. It has been found that an L-shaped tine 44 having a constant width w of about 2 inches works well.

It should be understood that a steel or metal plate could be secured between two adjacent L-shaped tines 44, 44, if desired, to form a more secure structure. It is also conceivable that one could form slots in a bucket which could then be attached to a motorized vehicle 12. The slotted bucket would be a variation of a pair of L-shaped tines 44, 44 having a steel or metal plate secured thereto.

Referring again to FIG. 5, the horizontal portion 46 of each L-shaped tine 44 has a length l and the vertical portion 48 of each L-shaped tine 44 has a height $h_1$. The length l of the horizontal portion 46 can range from between about 36 inches to about 60 inches. Desirably, the length l of the horizontal portion 46 ranges from between about 38 inches to about 50 inches. More desirably, the length l of the horizontal portion 46 is about 48 inches or less. The height $h_1$ of each of the vertical portions 48 can vary in dimensions. The height $h_1$ of each of the vertical portions 48 can range from between about 20 inches to about 42 inches. More desirably, the height $h_1$ of each of the vertical portions 48 can range from between about 22 inches to about 36 inches. Even more desirably, the height $h_1$ of the vertical portion 48 can range from between about 24 inches to about 32 inches. Most desirably, the height $h_1$ of the vertical portion 48 can be about 24 inches.

The length l of each of the horizontal portions 46 is greater than the height $h_1$ of each of the vertical portions 48. Desirably, the length l of each of the horizontal portions 46 can be about 1.5 times greater than the height $h_1$ of each of the vertical portions 48. More desirably, the length l of each of the horizontal portions 46 can be about 1.75 times greater than the height $h_1$ of each of the vertical portions 48.

Figure 5:
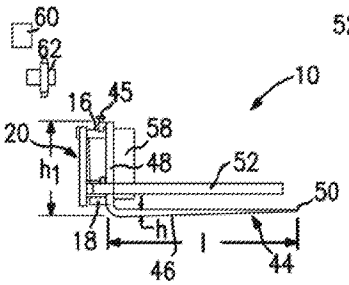
FIG. 5 is a side view of the pickup and alignment mechanism shown in FIG. 1.

Still referring to FIG. 5, the height h of the horizontal portion 46 of each of the L-shaped tines 44 taper downward towards a terminal end 50. The taper can be constant along the length l of the horizontal portion 46. Alternatively, the taper can extend along only a portion of the length l of each of the horizontal portions 46. The maximum dimension of the height h of each of the horizontal portions 46 occurs adjacent to the 90 degree bend where it joins the vertical portion 48. The height h dimension at the terminal end 50 can range from about 0.25 inches to about 0.75 inches. A height of about 0.5 inches or less, works well.

Referring again to FIG. 4, ten L-shaped tines 44 is shown which are grouped into five pairs of tines 44, 44. The distance d between each pair of L-shaped tines, 44, 44 can vary. The distance d between each of the pairs of L-shaped tines, 44, 44 can range from between about 8 inches to about 20 inches. The actual dimension for the distance d will depend on how many pieces of firewood one wishes to obtain from each approximately 100 inch log. For example, one could cut a 100 inch long log in three places and get four 25 inch lengths of firewood. Alternatively, one could cut a 100 inch long log in four places and get five 20 inch lengths of firewood. One could cut a 100 inch long log a fewer number of times or more than five times. A fewer number of cuts would result in longer lengths of firewood while more cuts would result in shorter lengths of firewood.

The distance $d_1$ between adjacent pairs of L-shaped tines 44, 44 can also vary. The distance $d_1$ between adjacent pairs of L-shaped tines 44, 44 can range from between about 2 inches to about 10 inches. Desirably, the distance $d_1$ between adjacent pairs of L-shaped tines 44, 44 can range from between about 3 inches to about 9 inches. More desirably, the distance $d_1$ between adjacent pairs of L-shaped tines 44, 44 can range from between about 4 inches to about 8 inches. Even more desirably, the distance $d_1$ between adjacent pairs of L-shaped tines 44, 44 can range from between about 5 inches to about 7 inches. Most desirably, the distance $d_1$ between adjacent pairs of L-shaped tines 44, 44 is about 6 inches.

The distance d between each pair of L-shaped tines 44, 44 is greater than the distance $d_1$ between each adjacent pair of L-shaped tines 44, 44. Desirably, the distance d between each of the pairs of L-shaped tines 44, 44 is more than twice the distance $d_1$ between each adjacent pair of L-shaped tines 44, 44. More desirably, the distance d between each of the pairs of L-shaped tines 44, 44 is more than 2.5 times the distance $d_1$ between each adjacent pair of L-shaped tines 44, 44.

For example, when eight L-shaped tines 44, each having a width w of about 2 inches, are utilized, each of the four pairs of L-shaped tines 44, 44 can be spaced a distance d of about 15 inches apart. The distance $d_1$ between adjacent pairs of L-shaped tines can be about 6 inches. This equates to (2+15+2+6+2+15+2+6+2+15+2+6+2+15+2)=94 inches. For a log having a length of approximately 100 inches, this leaves 3 inches extending off of each of the outer two L-shaped tines 44, 44 (3+94+3)=100 inches. Three cuts to a log having a length of approximately 100 inches will render four pieces of firewood from each log. Each piece of firewood would be approximately 25 inches in length.

When the pickup and alignment mechanism 10 utilizes ten L-shaped tines 44, each having a width w of about 2 inches, each of the five pairs of L-shaped tines 44, 44 can be spaced a distance d of about 13 inches apart. The distance $d_1$ between adjacent pairs of L-shaped tines 44, 44 can be about 6 inches. This equates to (2+12+2+5+2+12+2+5+2+12+2+5+2+12+2+5+2+12+2)=100 inches. For a log having a length of approximately 100 inches, this means there would be no overhang off of the outermost two L-shaped tines 44, 44. Four cuts to each of the 100 inch long logs will render five pieces of firewood from each log. Each piece of firewood would be approximately 20 inches in length.

It should be understood that one could cut each log having a length of approximately 100 inches five times to obtain six pieces of firewood from each log. Each piece of firewood would be approximately 16.65 inches in length.

It should also be understood that the pickup and alignment mechanism for logs 10 can use various numbers of L-shaped tines 44, 44 and the distances d and $d_1$ can vary to accommodate the length of firewood one desires to obtain. If one desired to cut firewood, each having a length of about 18 inches, then each of the L-shaped tines 44, 44 could be moved closer together. In addition, extra L-shaped tines 44, 44 can be added to the frame 14, if needed. Likewise, one or more of the L-shaped tines 44, 44 could be removed from the frame 14 if one wanted to cut longer lengths of firewood.

Referring again to FIGS. 1-4, the pickup and alignment mechanism for logs 10 also includes a pair of side tines 52, 52. Each of the pair of side tines 52, 52 is connected to a cylinder 54. The cylinder 54 can be a hydraulic cylinder, a pneumatic cylinder 54 or some other kind of pressurized cylinder known to those skilled in the art. The cylinder 54 can be actuated to simultaneously move the pair of side tines 52, 52 towards or away from one another. Alternatively, each side tine 52 can be connected to its own cylinder 54 so that it can move independent and/or sequentially from the other side tine 52.

Each of the pair of side tines 52, 52 can vary in configuration. As depicted, each of the pair of side tines 52, 52 has an L-shape configuration. A pair of cylinders 54, 54, see FIGS. 3 and 4, is shown which can activate the pair of side tines, 52, 52. Alternatively, a single cylinder 54 could be utilized to activate the pair of side tines 52, 52, if desired. The cylinder(s) 54, 54 can be operated hydraulically, pneumatically, or by some other way known to those skilled in the art. Hydraulic cylinders work well. One of the pair of side tines 52, 52 is positioned adjacent to the first end 26 of the second rail 18 and the other of the pair of side tines 52, 52 is positioned adjacent to the second end 28 of the second rail 18. Desirably, each of the pair of side tines 52, 52 is vertically positioned between the first and second rails, 16 and 18 respectively. Desirably, each of the pair of side tines 52, 52 is spaced from between 0 to about 6 inches above the horizontal portion 46 of each of the L-shaped tines 44, 44. At 0 inches, each of the pair of side tines, 52, 52 is level with the horizontal portion 46 of each of the L-shaped tines 44, 44. More desirably, each of the pair of side tines 52, 52 is spaced about 2 to about 3 inches above the horizontal portion 46 of each of the L-shaped tines 44, 44.

The pair of side tines 52, 52 operates such that each tine 52, 52 will move inward toward and outward away from the other side tine 52 by the same distance and at the same time when connected to a single cylinder 54. In other words, the pair of side tines, 52, 52 can move simultaneously. The pair of side tines 52, 52 functions to align the logs that have been picked up by the plurality of L-shaped tines 44, 44 of the pickup and alignment mechanism for logs 10. By activating the pair of side tines 52, 52 to move toward one another, the logs positioned on the plurality of tines 44 will be aligned into a row such that the ends of the logs are approximately aligned relative to one another. When two cylinders 54, 54 are utilized, the pair of side tines 52, 52 can be actuated to move independent of one another.

Figure 6:
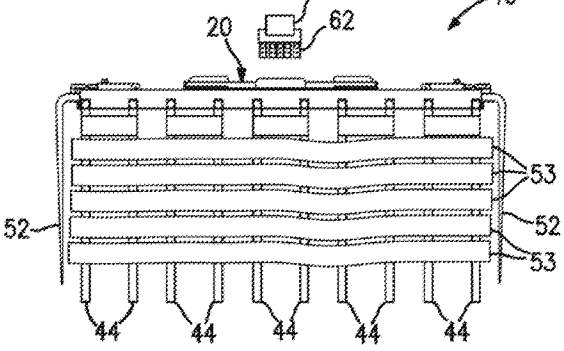
FIG. 6 is a top view of the pickup and alignment mechanism shown in FIG. 1 having six logs positioned on the plurality of L-shaped tines.

Referring to FIG. 6, six logs 53 are shown positioned on the plurality of L-shaped tines 44, 44. The logs 53 can vary in diameter. Typically, the diameter of the logs 53 will range from between about 2 inches to about 25 inches. Desirably, the diameter of the logs 53 will range from between about 4 inches to about 20 inches. More desirably, the diameter of the logs 53 will range from between about 6 inches to about 16 inches. If the diameter of a log 53 becomes too great, the piece of firewood may have to be split one or more times so that it will fit into a fireplace, a wood burning furnace, a stove, etc.

Referring again to FIG. 3, the pickup and alignment mechanism for logs 10 also includes one or more hoses 56, 56. A pair of hoses 56, 56 is shown being permanently connected to each of the cylinders 54, 54. The pair of hoses 56, 56 can be connected to hydraulic, pneumatic or some other type of connectors (not shown) which are located in or on the motorized vehicle 12. When hydraulic fluid is utilized, the motorized vehicle 12 will have a fluid reservoir that is connected to a fluid pump such that pressurized hydraulic fluid can be routed to the hydraulic connectors. When connected, the pair of hoses 56, 56 will allow pressurized hydraulic fluid to be supplied to the single cylinder 54 or to each of the cylinders 54, 54, when two cylinders 54, 54 are utilized. The movement of the pressurized hydraulic fluid into and out of the cylinder 54, or into and out of the two cylinders 54, 54, will actuate a piston (not shown) present in each of the cylinders 54. Hydraulic fluid is the desired fluid for activating the cylinders 54, 54 since many tractors, Bobcat®, and skid steer loaders are equipped with a hydraulic reservoir. However, pressurized air can also be used, if desired.

It should be noted that when a pair of hoses 56, 56 are utilized, one hose 56 can be connected to one end of the cylinder 54 and the other hose 56 can be connected to the opposite end of the cylinder 54. As pressurized hydraulic fluid or pressurized air is introduced to a first end of the cylinder 54, pressurized hydraulic fluid or air will exit the second end of the cylinder 54. This action will cause the piston located within the cylinder 54 to move back and forth. A piston rod secured to the piston will extend out of the cylinder 54 and be connected to one of the pair of side tines 52, 52. As the piston rod moves outward from the cylinder 54, it will cause the side tine 52 to swing inward. Likewise, as the piston rod moves inward into the cylinder 54, it will cause the side tine 52 to swing outward.

Referring again to FIGS. 1-5, the pickup and alignment mechanism for logs 10 further includes a number of bumpers 58. When ten L-shaped tines 44, 44 are present, five bumpers 58 will be present. If only eight L-shaped tines 44, 44 are present, only four bumpers 58 will be needed. Each bumper 58 is positioned between each of the pairs of L-shaped tines 44, 44. Each bumper 58 is movably secured to the vertical portion of each of the pairs of the L-shaped tines 44, 44. The bumpers 58, 58 can be mechanically attached using bolts and nuts or some other form of mechanical fastener known to those in the art. Each of the bumpers 58 is spaced apart from an adjacent bumper 58. Desirably, the distance between adjacent bumpers 58, 58 is about the same. The bumpers 58, 58 function to provide clearance such that a person with a saw, such as a chain saw (not shown), can cut the approximately 100 inch long logs 53 positioned on the plurality of L-shaped tines 44, 44 without contacting the frame 14 with the blade of the chain saw. In other words, the bumpers 58, 58 provide a space or clearance between the frame 14 and the log 53 resting adjacent to it.

In FIG. 4, five bumpers 58, 58 are shown. Each of the five bumpers 58 is spaced apart from an adjacent bumper 58 by a distance $d_2$. The distance $d_2$ can be the same between all of the adjacent bumpers 58. Alternatively, the bumpers 58, 58 can be spaced different distances $d_2$ apart. The five bumpers 58, 58 provide clearance such that a person with a chain saw (not shown) can cut the logs 53 positioned on the plurality of L-shaped tines 44, 44 without contacting the frame 14 with the blade of the chain saw.

The bumpers 58 can be formed from any known material. Such materials include, but are not limited to: steel, a steel alloy, metal, a metal alloy, wood, rubber, plastic, thermoplastic, composites, dosed or open cell foam, etc. In addition, a bumper 58 could be constructed from a soft material, such as a piece of pine wood. Another option is to cover the soft material with a thin metal plate having a thickness of about 1/16 of an inch or larger, to make it stronger.

Referring again to FIG. 2, each of the bumpers 58, 58 has a length $l_1$, a width $w_1$, and a thickness $t_1$. The length $l_1$, the width $w_1$, and the thickness $t_1$ can all vary in dimension. The length $l_1$ of each bumper 58 will partially depend on the overall size or height $h_1$ of the vertical portion 48 of each of the plurality of L-shaped tines 44, 44. The length $l_r$ of each bumper 58 is measured parallel to the height $h_1$ of the vertical portion 48. The length $l_1$ of each bumper 58 can be greater than, equal to or be less than the height $h_1$ of the vertical portion 48 of each of the plurality of L-shaped tines 44, 44. Desirably, the length $l_1$ of each of the bumpers 58, 58 will be equal to the height $h_1$ of the vertical portion 48 of each of the plurality of L-shaped tines 44, 44. More desirably, the length $l_1$ of each of the bumpers 58, 58 will be at least about 30% of the height $h_1$ of the vertical portion 48 of each of the plurality of L-shaped tines 44, 44. Even more desirably, the length $l_1$ of each of the bumpers 58, 58 will be equal to at least about 50% of the height $h_1$ of the vertical portion 48 of each of the plurality of L-shape tines 44, 44. Normally, the length $l_1$ of each of the bumpers 58, 58 can range from between about 4 inches to about 24 inches. Desirably, the length $l_1$ of each of the bumpers 58, 58 is between about 6 inches and 20 inches. More desirably, the length $l_1$ of each of the bumpers 58, 58 is between about 8 inches and 18 inches.

The width $w_1$ of each of the bumpers 58, 58 will be determined by the distance d that a pair of L-shaped tines 44, 44 is spaced apart from one another. The width $w_1$ of each of the bumpers 58, 58 should bridge across the distance d and include the width w of a pair of the L-shaped tines 44, 44. For example, if a pair of L-shaped tines 44, 44, each having a width w of about 2 inches, is spaced apart a distance d of about 13 inches apart, then the width $w_1$ of each of the bumpers 58, 58 should be (2 inches+13 inches+2 inches)=17 inches. The width $w_1$ of each of the bumpers 58, 58 can range from between about 12 inches to about 24 inches.

Each of the bumpers 58, 58 also has a thickness $t_1$. Typically, the thickness $t_1$ of each of the bumpers 58, 58 can range from between about 3 inches to about 12 inches. Desirably, the thickness $t_1$ of each of the bumpers 58, 58 can range from between about 4 inches to about 10 inches. More desirably, the thickness $t_1$ of each of the bumpers 58, 58 can range from between about 4 inches to about 8 inches. The thickness $t_1$ is important for it provides a buffer between the tip of the chain saw blade and the frame 14. Since the frame 14 is constructed from steel or metal, if the chain saw blade should contact it, the blade of the chain saw could be damaged. Each of the bumpers 58, 58 functions to provide a clearance between the frame 14 and the blade of the chain saw such that damage to the blade is prevented or minimized.

Still referring to FIG. 4, each of the bumpers 58, 58 is spaced apart from an adjacent bumper 58 by a set distance $d_2$. The distance $d_2$ can vary. The distance $d_2$ can range from between about 4 inches to about 10 inches. Desirably, the distance $d_2$ will range from between about 4 inches to about 8 inches. More desirably, the distance $d_2$ will be about 6 inches.

Referring again to FIG. 2, the pickup and alignment mechanism for logs 10 also includes a plurality of electrical switches 60 which are located on or in the cab of the motorized vehicle 12. The number of electrical switches 60 can vary. By flipping or turning on each electrical switch 60, one can activate a corresponding solenoid valve 62. The solenoid valves 62 can be secured to the motorized vehicle 12 as well. Each solenoid valve 62 will be connected to one of the cylinders 54, 54. In addition, one or more of the solenoid valves 62 can be connected to the cylinders which control the movement of the two forwardly extending arms (not shown) of the motorized vehicle 12. The two forwardly extending arms (not shown) can be attached to the face plate 20 so as to control the raising, lowering and tilting of the pickup and alignment mechanism for logs 10.

It should be understood that the electrical switches 60 are electrically connected to each of the solenoid valves 62, although not shown. Furthermore, each of the solenoid valves 62 is connected to a respective cylinder 54. A hydraulic motor or a pneumatic pump can also be utilized, if needed. The physical hose making this connection is not shown since this is well known in the art.

Referring again to FIG. 6, the pickup and alignment mechanism 10 is designed to operate such that the plurality of L-shaped tines 44, 44 can be maneuvered to pickup from between one to six logs 53 at a time. The logs 53 are each about 100 inches (8.3 feet) in length and some are in contact with the ground. For example, the logs 53 can be aligned parallel to one another and be stacked in an approximately triangular shaped pile. The logs 53 can be picked up and raised a desired distance above the ground. This distance can vary but usually ranges from between about 6 inches to about 24 inches. The pair of side tines 52, 52 can be activated to longitudinally align the logs 53 relative to one another to form a single row of logs 53. The ends of each log 53 will be in contact with the pair of side tines 52, 52 or be slightly spaced inward therefrom. The logs 53 are aligned in a single row on the plurality of L-shaped tines 44, 44. In other words, the logs 53 that have been picked up are not in a stack or bundle but instead are aligned essentially parallel to one another. In this configuration, the logs 53 can be individually cut at a number of different locations so that each of the logs 53 will be cut to create a number of individual pieces of firewood sized to fit into a log burning furnace, a stove, a fireplace, a camp fire, etc. In FIG. 6, each of the six logs 53 can be cut by a chain saw or by a hand saw at four spaced apart locations. This results in five pieces of firewood per log or 5×6 logs=30 pieces of firewood. The four cuts produce five 20 inch long pieces of firewood from each approximately 100 inch long log 53.

In FIG. 6, each of the approximately 100 inch logs 53 is cut into a number of pieces of firewood each having a predetermined length. The logs 53 can be individually cut by a person with a chain saw or a hand saw. The logs 53 can be raised from about 6 inches to about 24 inches off the ground by the pickup and alignment mechanism 10, so that the person with the chain saw or hand saw can walk up to the logs 53, and without having to bend down to ground level, easily and comfortably cut each log 53. Each log 53 can be cut in four separate locations which yields five piece of firewood. The person with the chain saw or hand saw is not required to bend over to the same extend as when the logs 53 are lying on the ground. This makes it more comfortable for the person with the saw. The diameter of each log 53 can vary but usually the harvested logs 53 have a diameter of from between about 2 inches to about 25 inches. Furthermore, the logs 53 are cut while being positioned on the plurality of L-shaped tines 44, 44 which are raised above the ground. This means that the blade of the chain saw or hand saw will not contact the ground and become dull or be damaged. The five cut pieces of firewood from each approximately 100 inch long log 53 will remain stationary on one of the five pairs of L-shaped tines 44, 44. The five cut pieces of firewood from each approximately 100 inch long log 53 will not fall off of the pairs of L-shaped tines 44, 44 after being cut. The cut pieces of firewood can then be transported to a storage area by the motorized vehicle 12 and can be off loaded and/or stacked in a sheltered area. The person or persons off loading the cut pieces of firewood do not have to bend over to pick up each piece of firewood. Instead, the cut pieces of firewood can be raised to a desired height by the pickup and alignment mechanism 10 so that the person simply has to move the pieces of firewood laterally. This makes the job easier and quicker with less bending and lifting. Alternatively, the cut pieces of firewood can be transported to a wagon and/or be raised so that the pieces of firewood can be dumped into the wagon without any physical labor.

It should be understood that the pickup and alignment mechanism 10 can be tilted forward and/or backward by the connector 36 such that the plurality of L-shaped tines 44, 44 can be angled above horizontal, be horizontally aligned, or be angled below horizontal. The number of degrees that the plurality of L-shaped tines 44, 44 can be tilted can vary. This angle can range from between about +45 degrees to −45 degrees from the horizontal position.

Referring now to FIGS. 7-11, a second embodiment of a pickup and alignment mechanism for logs 10' is shown. In this embodiment, like numerals refer to similar elements as were shown in FIGS. 1-6. This pickup and alignment mechanism 10' differs from the previously disclosed pickup and alignment mechanism 10 in that it includes a first chain saw 64, a second chain saw 66, and a third chain saw 68. In addition, the pickup and alignment mechanism 10' uses eight L-shaped tines 44, 44 instead of ten, and therefore needs only four bumpers 58, 58. Each of the first, second and third chain saws, 64, 66 and 68 respectively, can be a typical chain saw having a chain saw blade 70 that can vary in length. Each chain saw blade 70 should be at least 36 inches in length. More desirably, each chain saw blade 70 should be at least 48 inches in length. Even more desirably, each chain saw blade 70 should be at least 60 inches in length. Most desirably, each chain saw blade 70 is greater than 60 inches. All three chain saws 64, 66 and 68 can be of the same length.

Figure 8:
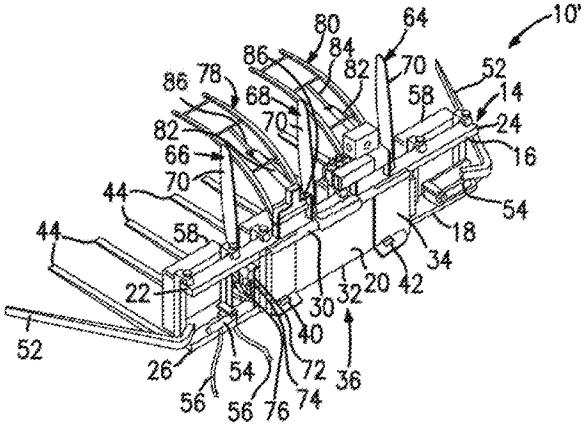
FIG. 8 is a rear isometric view of the pickup and alignment mechanism shown in FIG. 7.
Figure 11:
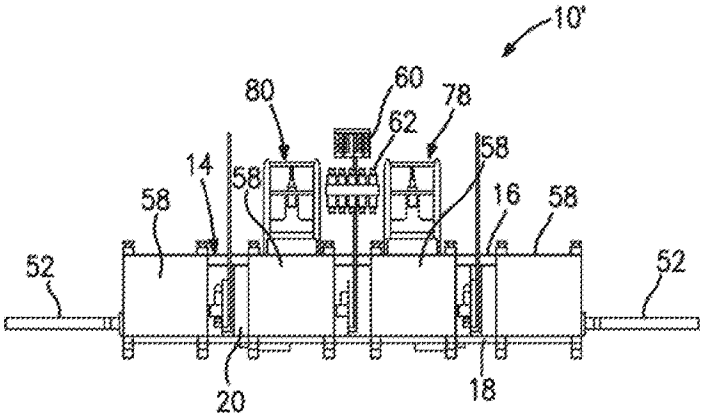
FIG. 11 is a front view of the pickup and alignment mechanism shown in FIG. 7.

Referring to FIG. 8, each of the first, second and third chain saws, 64, 66 and 68 respectively, is pivotably mounted to the frame 14. The exact method of attachment can vary. For example, all three of the chain saws 64, 66 and 68 can be mounted on a single horizontal shaft. Alternatively, each of the three chain saws 64, 66 and 68 can be individually mounted to the frame 14 on a separate shaft. In FIG. 8, each of the first, second and third chain saws, 64, 66 and 68 respectively, is individually mounted to the frame 14. Each of the first, second and third chain saws, 64, 66 and 68 respectively, can be pivoted by use of a hydraulic, pneumatic or some other type of cylinder 72 known to those skilled in the art. Desirably, the cylinder 72 is a hydraulic cylinder. As pressurized fluid or air is routed to a first end of the cylinder 72, it causes a piston (not shown), located within the cylinder 72, to move in an opposite direction. A piston rod 74 attached to the piston extends out of the cylinder 72 and is coupled to one of the three chain saws 64, 66 or 68 via a linkage 76. As the piston rod 74 extends outward, it causes the linkage 76 to move, which in turn causes one of the three chain saws 64, 68 or 68 to pivot. The use of various cams, linkages, etc. for causing each of the three chain saws 64, 66 and 68 to pivot are well known to those skilled in the art.

The first, second and third chain saws, 64, 66 and 68 respectively, are positioned between each of the four pairs of L-shaped tines 44, 44 with the third chain saw 68 being located in the middle between the first and second chain saws, 64 and 66 respectively. Each of the first, second and third chain saws, 64, 66 and 68 respectively, can be electrically started in the motorized vehicle 12 by using an electrical switch 60, as explained above. Alternatively, each of the first, second and third chain saws, 64, 66 and 68 respectively, can be manually started. In addition, each of the first, second and third chain saws, 64, 66 and 68 respectively, can be operated by using pressurized fluid or air routed by activation of a solenoid valve 62, as was explained above regarding operation of the hydraulic or pneumatic cylinders 54, 54.

Each of the three chain saws, 64, 66 and 68 respectively, can have a blade 70 which is of the same length. Alternatively, one or two of the chain saws 64, 66 and 68 respectively, can have a blade 70 which is shorter or longer than the blade 70 of the remaining chain saw. Desirably, all three chain saws 64, 66 and 68 have blades 70, 70 and 70 of the same length, as is shown in FIGS. 7 and 8.

Figure 9:
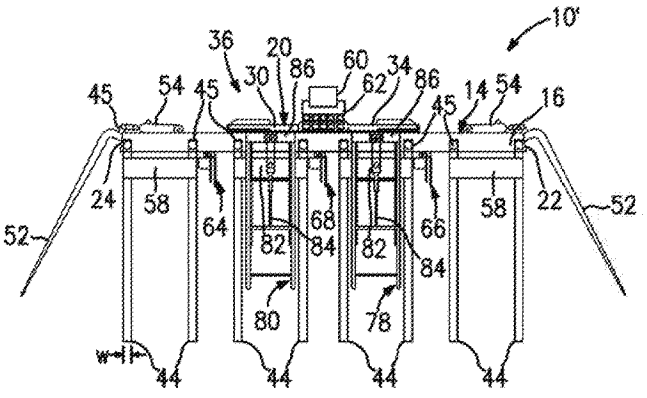
FIG. 9 is a top view of the pickup and alignment mechanism shown in FIG. 7.
Figure 10:
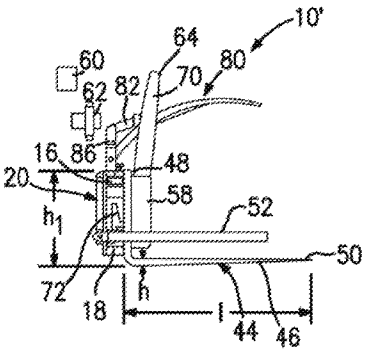
FIG. 10 is a side view of the pickup and alignment mechanism shown in FIG. 7.

Referring now to FIGS. 9 and 10, the first chain saw 64 is started or turned on via one of the electrical switches 60 and this activates one of the solenoid valves 62. With the first chain saw 64 running and with from one to six logs 53, each having an overall length of about approximately 100 inches (about 8.3 feet), positioned on the plurality of L-shaped tines 44, 44, the first chain saw 64 is pivoted downward by the cylinder 72, see FIG. 10. The logs 53, (not shown) will be bunched up into a triangular or three-sided profile by the grappling member 78 as will be explained shortly. As the blade 70 of the first chain saw 64 is lowered, it will come into contact with the upper most log 53 or with the log 53 located farthest from the bumper 58. The blade 70 of the first chain saw 64 will cut through the one to six logs 53 and create one to six pieces of firewood each having a length of approximately 25 inches. Each of the individual pieces of firewood will remain on the left outermost pair of L-shaped tines 44, 44. The "left" set of L-shaped tines 44, 44 are located on the left when one views FIG. 9.

Figure 7:
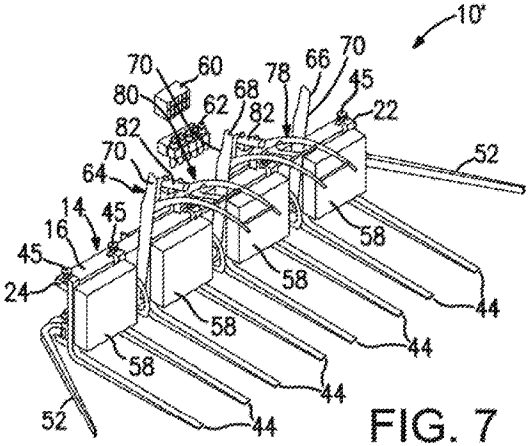
FIG. 7 is a front isometric view of a second embodiment of a pickup and alignment mechanism having three chain saws and two grappling members.

Still referring to FIG. 9, after all of the one to six logs 53 have been cut by the first chain saw 64, the first chain saw 64 is moved or pivoted back to its initial starting position, as is shown in FIG. 7. At this time, the second chain saw 66 is started or turned on via one of the electrical switches 60 and this activates one of the solenoid valves 62. With the second chain saw 66 running and with from one to six logs 53 positioned on the plurality of L-shaped tines 44, 44, the second chain saw 66 is pivoted downward by its cylinder 72. This action will allow the blade 70 of the second chain saw 66 to come into direct contact with the upper most log 53 or the log 53 located farthest from the bumper 58. The blade 70 of the second chain saw 66 will cut through the logs 53 and create one to six pieces of firewood each having a length of approximately 25 inches. Each of the individual pieces of firewood will remain on the right outermost pair of L-shaped tines 44, 44. The "right" set of L-shaped tines 44, 44 are located on the right when one views FIG. 9.

Still referring to FIG. 9, after all of the logs 53 have been cut by the second chain saw 66, the second chain saw 66 is moved or pivoted back to its initial starting position, as is shown in FIG. 7. At this time, the third or middle chain saw 68 is started or turned on via one of the electrical switches 60 and this activates one of the solenoid valves 62. With the third chain saw 68 running and with from one to six logs 53 positioned on the plurality of L-shaped tines 44, 44, the third or middle chain saw 68 is pivoted downward by its cylinder 72. This action will allow the blade 70 of the third chain saw 68 to come into direct contact with the upper most log 53 or the log located farthest from the bumper 58. The blade 70 of the third chain saw 68 will cut through the one to six logs 53 and create two additional pieces of firewood from each log 53, with each piece of firewood having a length of approximately 25 inches. Each of the individual pieces of firewood will remain on the middle two pairs of L-shaped tines 44, 44.

After all of the logs 53 have been cut by the third chain saw 68, the third chain saw 68 is moved or pivoted back to its initial starting position, as is shown in FIG. 7. This sequential action by the first, second and third chain saws, 64, 66 and 68 respectively, creates four pieces of firewood from each of the logs 53. Therefore, if six logs 53 where positioned on the plurality of L-shaped tines 44, 44, then after the three cuts, one would have (6 logs×4 pieces)=24 pieces of firewood with each piece of firewood having a length of approximately 25 inches. The twenty-four pieces of firewood can then be transported to a storage area, collection site, wagon, etc. as was explained above.

It should be understood that one or more conduits (not shown) can be present which route pressurized fluid or air between the motorized vehicle 12 and each of the first, second and third chain saws, 64, 66 and 68 respectively. The pressurized fluid or air is used to operate each of the first, second and third chain saws, 64, 66 and 68 respectively. Desirably, the pressurized fluid is a hydraulic fluid.

Referring again to FIGS. 7-11, the four bumpers 58, 58, 58 and 58 provide clearance so that each of the first, second and third chain saws, 64, 66 and 68 respectively, can completely cut through each of the one to six logs 53 positioned on the plurality of L-shaped tines 44, 44. The plurality of L-shaped tines 44, 44 can be maneuvered to pickup from between one to six logs 53 at a time, as was described above, and raise the logs 53 a desired distance above the ground. The pair of side tines 52, 52 can be activated to longitudinally align the one to six logs 53 relative to one another so that they can be cut to a desired length by the first, second and third chain saws, 64, 66 and 68 respectively. The first, second and third chain saws, 64, 66 and 68 respectively, are sequentially operated such that the first chain saw 64 will make a cut through each of the one to six logs 53 positioned on the eight L-shaped tines 44, 44. The second chain saw 66 will then make a cut through each of the one to six logs 53 positioned on the eight L-shaped tines 44, 44. Lastly, the third or middle chain saw 68 will make a cut through each of the one to six logs 53 positioned on the eight L-shaped tines 44, 44. By using this sequence, one does not have to worry about the third chain saw 68 binding or getting pinched between the logs 53 it is cutting through.

Still referring to FIGS. 7-11, the pickup and alignment mechanism 10' also differs from the first embodiment 10 in that it includes a pair of grappling members 78 and 80. By "grapple" it is meant the act of grappling, to grasp or grip. The grappling member 78 can be identical in construction to the grappling member 80. Alternatively, each grappling member 78 and 80 can be different in construction. Desirably, each of the grappling members 78 and 80 are identical in construction. Each of the pair of grappling members 78 and 80 can vary in size, construction and design. As illustrated, each of the pair of grappling members 78 and 80 is an arcuate, ladder like member which is pivotably mounted to the frame 14. Each of the pair of grappling members 78 and 80 includes a cylinder 82. Each cylinder 82, 82 can be actuated hydraulically, pneumatically or in some other fashion well known to those skilled in the art. Desirably, the cylinders 82, 82 are hydraulically operated. Each of the cylinders 82, 82 can be activated using an electrical switch 60 positioned in the motorized vehicle 12, as explained above. In addition, each of the cylinders 82, 82 can be operated by using pressurized fluid or air routed by activation of a solenoid valve 62, as was also explained above.

Each of the pair of grappling member 78 and 80 further includes a first linkage 84, see FIG. 9, connecting the piston rod of each cylinder 82, 82 to a portion of the arcuate, ladder like member, and a second linkage 86 connecting the opposite end of the cylinders 82, 82 to the frame 14. The exact configuration of the first and second linkages, 84 and 86 respectively, can vary.

The pair of grappling members 78 and 80 is located on either side of the third or middle chain saw 68. The pair of grappling members 78 and 80 function to retain the one to six logs 53 in a bunched or three-sided configuration on the plurality of L-shaped tines 44, 44. The pair of grappling members 78 and 80 also functions to hold the one to six logs 53 stationary so that they can be sequentially cut by the first, second and third chain saws, 64, 66 and 68 respectively. The pair of grappling members 78 and 80 would be raised to an open or upward position, see FIG. 7, when the pickup and alignment mechanism 10' is brought into contact with a pile of logs 53 positioned on the ground. After one to six logs 53 are positioned on the plurality of L-shaped tines 44, 44, the pair of grappling members 78 and 80 can be closed or lowered downward (not shown) so as to hold the logs 53 steady on the plurality of L-shaped tines 44, 44.

The pair of grappling members 78 and 80 will remain in the dosed or downward position as the first, second and third chain saws, 64, 66 and 68 respectively, sequentially cut each of the one to six logs 53. The location of the pair of grappling members 78 and 80 does not interfere with the operation of the first, second and third chain saws, 64, 66 and 68 respectively. The pair of grappling members 78 and 80 can be opened or moved to the upward position when the cut pieces of firewood are to be off loaded. It should be noted that each of the grappling members 78 and 80 can move independent of the other grappling member. Alternatively, both of the grappling members 78 and 80 can be designed to move as a unit.

Figure 12:
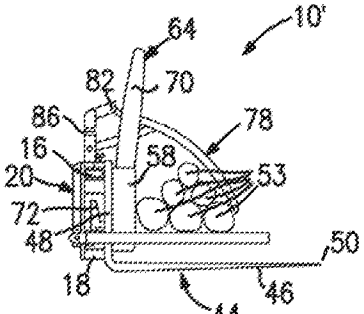
FIG. 12 is a side view of the pickup and alignment mechanism shown in FIG. 7 with the grappling member is a down position holding the six logs stationary.
Figure 15:
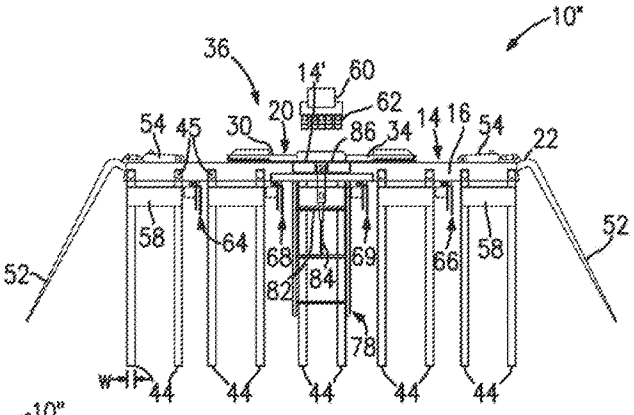
FIG. 15 is a top view of the pickup and alignment mechanism shown in FIG. 13.

Referring now to FIG. 12, a side view of the pickup and alignment mechanism 10' is shown with the grappling member 78 in a down position holding six logs 53, arranged in an approximately three-sided polygon configuration, stationary. With the pickup and alignment mechanism 10', the logs 53 are grouped together by the grappling members 78 and 80, while with the pickup and alignment mechanism 10, the six logs 53 are aligned adjacent to one another in a single row.

It should be understood that the one to six logs 53 will be held stationary by the grappling members 78 and 80. The configuration of the logs 53 will vary depending on how many logs 53 are retained by the grapping members 78 and 80. If only one log 53 is picked up, it would be retained against the bumpers 58, 58. If two logs 53, 53 are picked up, they can be positioned side by side or with one above the other. If three, four, five or six logs 53 are picked up, they could form a three-sided polygon. The three-sided polygon can be a right angled triangle, an equal lateral triangle or some other geometrical configuration. Since the logs 53 can have different diameters, can taper along their lengths, are not perfectly straight, can contain knots, stubs of branches, forks, can contain various kinds of bark, etc., the configuration of the logs 53 can form various geometrical shapes.

Referring now to FIGS. 13-17, a third embodiment of a pickup and alignment mechanism for logs 10" is shown. In this embodiment, like numerals refer to similar elements as were shown in FIGS. 1-6. The pickup and alignment mechanism 10"differs from the second previously disclosed pickup and alignment mechanism 10' in that it includes ten L-shaped tines 44, 44, similar to what is shown in FIGS. 1-6. In addition, the pickup and alignment mechanism 10"utilizes four chain saws and a single grappling member. The four chain saws include a first chain saw 64, a second chain saw 66, a third chain saw 68 and a fourth chain saw 69. The third and fourth chain saws, 68 and 69 respectively, are positioned between the first and second chain saws, 64 and 66 respectively. Each of the four chain saws 64, 66, 68 and 69 has a chain saw blade 70. The four chain saws 64, 66, 68 and 69 should be operated sequentially to prevent one of the chain saw blades 70 from becoming wedged or pinched as a cut is being made. Desirably, the first chain saw 64 will cut the one to six logs 53 and then be raised back up to its initial position shown in FIG. 13. The second chain saw 66 will then make its cut through the one to six logs 53 and then be raised up to its initial position. The third chain saw 68 will then make its cut through the one to six logs 53 and then be raised up to its initial position. Lastly, the fourth chain saw 69 will make its cut through the one to six logs 53 and then be raised up to its initial position.

The pickup and alignment mechanism 10" contains a single grappling member 78 which can be constructed to be identical to that described in FIGS. 7-12. The grappling member 78 is an arcuate, ladder like member which is pivotably mounted to the frame 14. The grappling member 78 includes a cylinder 82. Desirably, the cylinder 82 is operated by a hydraulic fluid, although a pneumatic or some other type of cylinder, known to those skilled in the art, could also be used. The cylinder 82 can be activated using an electrical switch 60 positioned in the motorized vehicle 12, as explained above. In addition, the cylinder 82 can be operated by using pressurized fluid or air routed by activation of a solenoid valve 62, as was also explained above. The grappling member 78 further includes a first linkage 84 connecting the piston rod of the cylinder 82 to a portion of the arcuate, ladder like member, and a second linkage 86 connecting the opposite end of the cylinder 82 to the frame 14. The exact configuration of the first and second linkages, 84 and 86 respectively, can vary.

The grappling member 78 is located between the third and fourth chain saws, 68 and 69 respectively. The grappling member 78 functions to retain the one to six logs 53 in an approximate three-sided polygon configuration on the plurality of L-shaped tines 44, 44, as was explained above with reference to FIG. 12. The grappling member 78 also functions to hold the one to six logs 53 in a stationary fashion so that they can be sequentially cut by the first, second, third and fourth chain saws, 64, 66, 68 and 69 respectively. The grappling member 78 starts out in an open or upward position, see FIG. 13. The pickup and alignment mechanism 10" then engages with from one to six logs 53 so that they are positioned in a generally parallel fashion on the plurality of L-shaped tines 44, 44. The grappling member 78 is then closed or lowered downward (not shown) such that it contacts the log 53 or logs 53 and holds them stationary.

The grappling member 78 will remain in the closed or downward position as the first, second, third and fourth chain saws, 64, 66, 68 and 69 respectively, sequentially cut each of the one to six logs 53. The location of the grappling member 78 does not interfere with the operation of the first, second, third and fourth chain saws, 64, 66, 68 and 69 respectively. The grappling member 78 can be opened or moved to the upward position when the cut pieces of firewood are to be off loaded.

Figure 17:
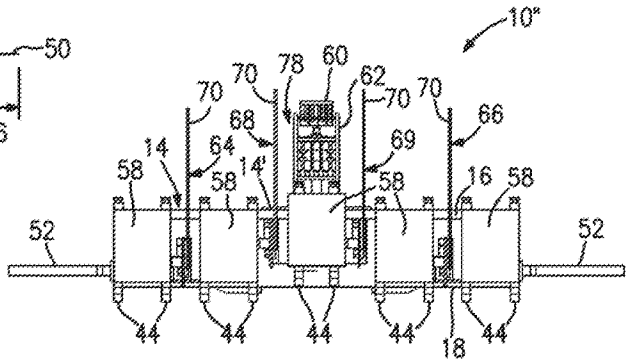
FIG. 17 is a front view of the pickup and alignment mechanism shown in FIG. 13.
Figure 16:
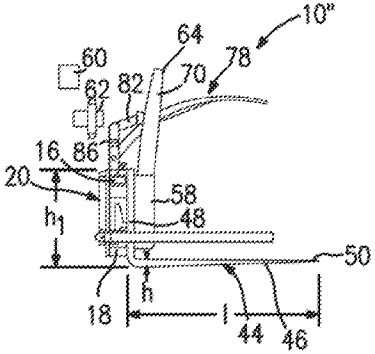
FIG. 16 is a side view of the pickup and alignment mechanism shown in FIG. 13.
Figure 13:
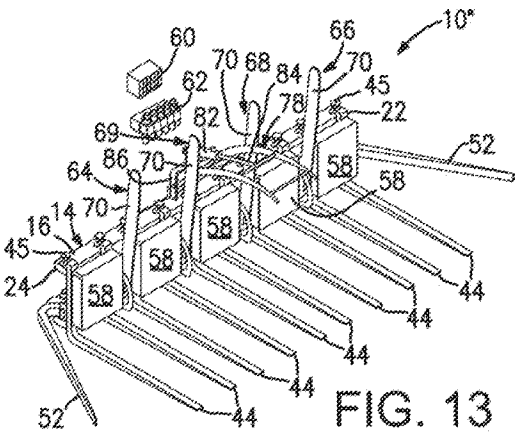
FIG. 13 is a front isometric view of a third embodiment of a pickup and alignment mechanism having four chain saws and one grappling member.
Figure 14:
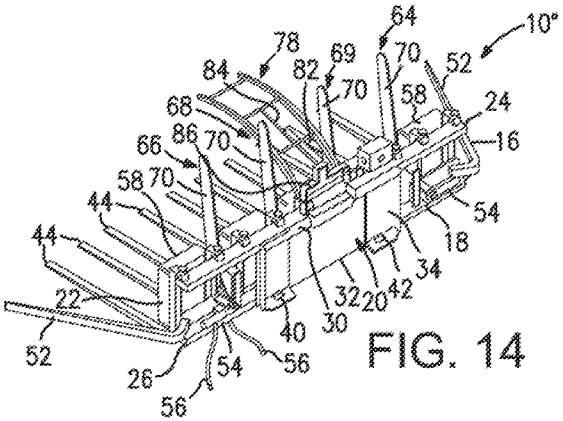
FIG. 14 is a rear isometric view of the pickup and alignment mechanism shown in FIG. 13.

Referring now to FIG. 17, one will notice that the middle two L-shaped tines 44, 44 and the attached bumper 58 are raised vertically relative to the frame 14. It should be understood that the middle two L-shaped tines 44, 44 are attached to their own frame member 14' so that they can be raised vertically relative to the remaining L-shaped tines 44, 44. The movable frame 14' can be actuated using hydraulic or pneumatic pressure. By raising the two middle L-shaped tines 44, 44, the ends of each of the logs 53, 53 positioned thereon can sag. This sagging helps to prevent the logs 53, 53 from binding or pinching against the blades 70, 70 of the third and fourth chain saws, 68 and 69 respectively. This is important when the grappling member 78 is utilized. Since the grappling member 78 is exerting a downward force on the logs 53, by raising the center portion of each log 53, the logs 53 can be cut without binding or pinching the blades 70, 70 of the third and fourth chain saws, 68 and 69 respectively. The middle two L-shaped tines 44, 44 needs only be raised a small amount. The middle two L-shaped tines 44, 44 can be raised from between about 2 inches to about 8 inches to prevent binding of the chain saw blades 70, 70. Desirably, the middle two L-shaped tines 44, 44 are raised from between about 3 inches to about 6 inches to prevent binding of the chain saw blades 70, 70.

It should be understood that the third and fourth chain saws, 68 and 69 respectively, are also raised relative to the frame 14. The third and fourth chain saws, 68 and 69 respectively, are secured to the movable frame 14' so that they can be raised. The movable frame 14' can vary in design and construction.

Figure 18:
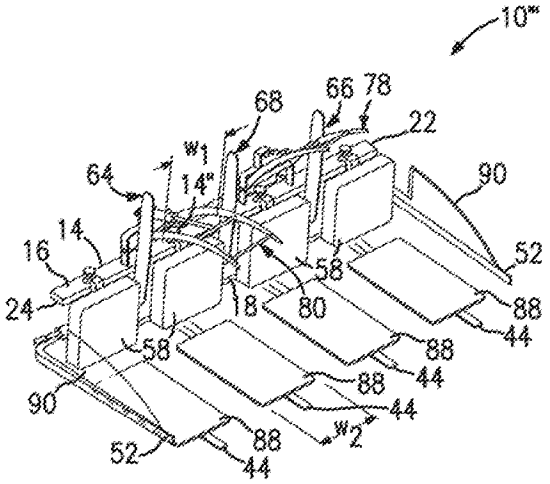
FIG. 18 is a front isometric view of a fourth embodiment of a pickup and alignment having three chain saws and two grappling members.

Referring now to FIG. 18, a fourth embodiment of a pickup and attachment mechanism for logs 10''' is shown. The pickup and attachment mechanism 10''' is similar to that shown in FIGS. 7-11 except for a few differences. First, each of the four pairs of L-shaped tines 44, 44 is replaced by a single tine 44, each having a flat plate 88 secured thereto. Only four L-shaped tines 44, 44, 44 and 44 are needed in this embodiment instead of eight L-shaped tines 44. Each of the four plates 88 can vary in size, thickness and configuration. As depicted, each of the four plates 88, 88, 88 and 88 has a generally rectangular shape. Each of the four plates 88, 88, 88 and 88 can be welded onto an upper surface of each of the four L-shaped tines 44, 44, 44 and 44. Each of the four plates 88, 88, 88 and 88 has a width $w_2$ which is approximately equal to the width $w_1$ of each of the four bumpers 58, 58, 58 and 58. Desirably, the width $w_2$ of each plate 88 is equal to the width $w_1$ of each bumper 58.

Another difference of the pickup and attachment mechanism 10''' in FIG. 18 is that each of the pair of side tines 52, 52 has a vertical extension 90, 90. Each of the vertical extensions 90, 90 can vary in size, thickness and configuration. Each of the vertical extensions 90, 90 is depicted as having an approximately triangular shape, similar to the shape of a feather on an arrow. The vertical extensions 90, 90 assist in keeping the logs 53 aligned, especially when one log 53 is positioned above another log 53. When one or more grappling members 78 and/or 80 are utilized, the logs 53 become stacked up into an approximately three-sided polygon configuration, for example, a triangular configuration, see FIG. 12, instead of remaining in a single row as is shown in FIG. 6 when no grappling member 78 or 80 is present. By bunching the logs 53 up, the grappling members 78 and 80 are better able to hold the logs 53 stationary as they are being cut by the first, second and third chain saws 64, 66 and 68 respectively.

Figure 19:
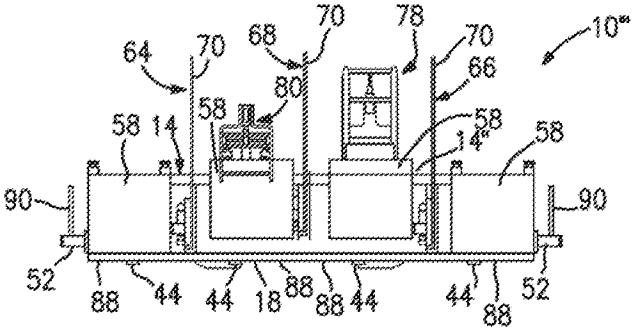
FIG. 19 is a front view of the pickup and alignment mechanism shown in FIG. 18.

Referring now to FIG. 19, a front view of the pickup and attachment mechanism 10''' is shown. One will notice that the middle two L-shaped tines 44, 44 and the attached bumpers plates 88, 88 and bumpers 58, 58 are secured to their own movable frame member 14". This frame member 14" allows these components to be raised vertically relative to the frame 14. It should be understood that the movable frame member 14" can vary in design and construction. By raising the two middle tines 44, 44 and the attached plates 88, 88, the ends of each of the logs 53, 53 positioned thereon will be able to sag. This sagging helps to limit or prevent the logs 53, 53 from binding or pinching against the blades 70, 70 of the third or middle chain saws 68. This is important when the grappling member 78 is utilized. Since the grappling member 78 is exerting a downward force on the logs 53, by raising the center portion of each log 53, the logs 53 can be cut without binding or pinching the third or middle chain saw 68. The middle two L-shaped tines 44, 44 and the attached plates 88, 88 needs only be raised a small amount. The middle two L-shaped tines 44, 44 and the attached plates 88, 88 can be raised from between about 2 inches to about 8 inches to prevent binding of the chain saw blade 70. Desirably, the middle two L-shaped tines 44, 44 and the attached plates 88, 88 are raised from between about 3 inches to about 6 inches to prevent binding of the chain saw blade 70.

It should be understood that the third or middle chain saws 68 is mounted to the movable frame 14" and therefore can be raised relative to the frame 14. The movable frame 14" can be actuated using hydraulic or pneumatic pressure.

In FIG. 19, the grappling member 80 is shown in a down position while the grappling member 78 is shown in an up position. Each grappling member 78 and 80 can be independently actuated. In addition, one could design and construct of the pair of side tines 52, 52 such that each one would move independently, if desired.

It should be understood that when operating the pickup and alignment mechanism 10', 10" or 10''' it will be necessary to supply lubricating oil to the blades 70 of each of the chain saws 64, 66 and 68 or 64, 66 68 and 69. Lubricating oil can be supplied to each of the blades 70 several different ways. One way is to attach an oil reservoir (not shown) to the frame 14, 14' or 14" and allow the oil to be directed to each of the blades 70 by gravity. Another way to accomplish this is to cap or close the ends of the first rail 16 and use it as an oil reservoir. Three or four holes can be drilled in the first rail 16 and a connecting hose can be connected to each of the holes. Each of the connecting hoses can be positioned adjacent to each of the blades 70. Other ways of lubricating the blades 70 of each of the chain saws 64, 66 and 68 or 64, 66, 68 and 69 can also be utilized.

METHOD

A method of using the pickup and alignment mechanism 10 will now be described so as to enable a person with a saw, desirably a chain saw, to cut each log 53 into smaller pieces of firewood. The method includes the steps of physically mounting or attaching the pickup and alignment mechanism 10 to a hitch secured to a motorized vehicle 12. The pickup and attachment mechanism 10 is also connected to a hydraulic or pneumatic system present on the motorized vehicle 12. It is well known to those skilled in the art that many tractors, such as farm tractors, Bobcats®, backhoes, forklifts, construction equipment, as well as other kinds of utility vehicles, commonly have a hydraulic or pneumatic system which includes various components, such as a reservoir, a pump, a motor, hoses, valves, controls, etc. for supplying pressurized fluid or air to an attached implement. A hydraulic system is most desirable.

The motorized vehicle 12 is started to pressurize the hydraulic or pneumatic system. The motorized vehicle 12 is then maneuvered so that the plurality of L-shaped tines 44, 44 will engage a pile of cut logs stacked on the ground. Each of the logs 53 will have a length of approximately 100 inches. The plurality of L-shaped tines 44, 44 will contact and remove from between one to six logs 53 from the pile. The logs 53 will be aligned approximately parallel to one another and be arranged as a single row on the plurality of L-shaped tines 44, 44. The logs 53 are then raised above ground level by elevating the plurality of L-shaped tines 44, 44 to a desired height. The logs 53 can be raised any desired distance. Typically, the logs 53 are raised from between about 1 inch to a few feet above ground level. Desirably, the logs 53 are raised from between about 6 inches to about 24 inches above ground level. More desirably, the logs 53 are raised from about 12 inches to about 20 inches above ground level. The motorized vehicle 12 can then be maneuvered away from the pile of logs positioned on the ground. This will create room for a person with a chain saw to approach the front of the pickup and alignment mechanism 10 and cut each of the logs 53 into smaller pieces.

A method of using the pickup and alignment mechanisms 10', 10" and 10'" differs in that the grappling members 78 and 80 can be lowered to contact and group the one to six logs 53 into a three-sided polygon configuration and will hold them stationary as the three chains saws 64, 66 and 68, or the four chain saws 64, 66, 68 and 69, sequentially engage and cut the logs 53 into smaller piece. The cut firewood can then be transported by the motorized vehicle 12 to a stacking or off-loading location. Here, the grappling members 78 and 80 are raised and the firewood can be removed from the plurality of L-shaped tines 44, 44.

While the invention has been described in conjunction with several specific embodiments, it is to be understood that many alternatives, modifications and variations will be apparent to those skilled in the art in light of the foregoing description. Accordingly, this invention is intended to embrace all such alternatives, modifications and variations which fall within the spirit and scope of the appended claims.

I claim:

1. A pickup and alignment mechanism for logs comprising:

a) a frame including a first rail, a second rail and a face plate, said first rail being spaced apart from said second rail, said first and second rails each having a first end and a second end, said face plate connecting said first rail to said second rail, and said face plate having an upper edge positioned adjacent to said first rail and a lower edge positioned adjacent to said second rail;

b) a connector secured to said face plate which allows said pickup and attachment mechanism to be attached to a motorized vehicle, said connector including a first abutment point located adjacent to said upper edge of said face plate, second and third spaced apart attachment points located adjacent to said lower edge of said face plate, and said first abutment point being located approximately midway between said second and third attachment points;

c) five pairs of tines, each of said five pairs of tines comprising two individual tines, each of said individual tines being an integral member having an L-shaped configuration which includes a horizontal portion aligned approximately perpendicular to said frame and a vertical portion secured to said first and second rails, said two individual tines in each of said pairs of tines are separated by a distance d, and each of said five pairs of tines is separated from an adjacent pair of tines by a distance $d_1$, and d is greater than $d_1$;

d) a pair of side tines, each of said pair of side tines connected to one of a pair of cylinders which can be actuated to move each of said pair of side tines separately towards and away from one another, one of said pair of side tines being positioned adjacent to said first end of said second rail and said other of said pair of side tines being positioned adjacent to said second end of said second rail;

e) a hose for supplying pressurized fluid or air between said motorized vehicle and each of said pair of cylinders, and said pressurized fluid or air actuates said pair of cylinders; and f) a plurality of bumpers each formed from a hard material, each of said bumpers positioned between two individual tines which makeup each of said five pairs of tines, each of said bumpers movably secured to said frame by a mechanical fastener, each of said bumpers being spaced apart from an adjacent bumper, each of said bumpers providing clearance such that said logs positioned on said five pairs of tines can be cut with a chain saw without said chain saw contacting said frame, and said five pairs of tines can be maneuvered to pickup from between one to six logs at a time and raise said logs a desired distance above the ground, and said pair of side tines can longitudinally align said logs relative to one another so that they can be cut to a desired length.

2. The pickup and alignment mechanism of claim 1 wherein each of said bumpers is formed from wood.

3. The pickup arid alignment mechanism of claim 1 wherein each of said bumpers is formed from steel.

4. The pickup and alignment mechanism of claim 1 wherein each of said bumpers is formed from a steel alloy.

5. The pickup and alignment mechanism of claim 1 wherein each of said bumpers is formed from metal, and said horizontal portion of each of said individual tines has a length and said vertical portion of each of said individual tines has a height, and said length of said horizontal portion is greater than said height of said vertical portion, and each of said individual tines has a width of at least 2 inches.

6. The pickup and alignment mechanism of claim 1 wherein each of said bumpers is formed from a metal alloy.

7. The pickup and alignment mechanism of claim 1 wherein each of said bumpers is formed from rubber.

8. The pickup and alignment mechanism of claim 1 wherein each of said bumpers is formed from a piece of pine wood which is covered with a thin metal plate.

9. The pickup and alignment mechanism of claim 1 wherein each of said bumpers has a length, a width and a thickness, said thickness ranges from between 3 inches to 12 inches, and each of said bumpers is spaced apart from an adjacent bumper by a distance ranging from between 4 inches to about 10 inches, and each of said bumpers is formed from steel.

10. A pickup and alignment mechanism for logs which is capable of being attached to a motorized vehicle, comprising:

a) a frame including a first rail, a second rail and a face plate, said first rail being spaced apart from said second rail, said first and second rails each having a first end and a second end, said face plate connecting said first rail to said second rail, and said face plate having an upper edge positioned adjacent to said first rail and a lower edge positioned adjacent to said second rail;

b) a connector secured to said face plate which allows said pickup and attachment mechanism to be attached to said motorized vehicle, said connector including a first abutment point located adjacent to said upper edge of said face plate, second and third spaced apart attachment points located adjacent to said lower edge of said face plate, and said first abutment point being located approximately midway between said second and third attachment points;

c) a first pair, a second pair, a third pair and a fourth pair of tines, each of said first, second, third and fourth pairs of tines comprising two individual tines, each of said individual tines being an integral member having an L-shaped configuration which includes a horizontal portion aligned approximately perpendicular to a vertical portion, said horizontal portion having a length and said vertical portion having a height, each vertical portion being movably secured to both said first and second rails such that each of said individual tines can be moved along the length of said first and second rails, said individual tines in each of said first, second, third and fourth pairs of tines are separated by a distance d, and each of said first, second, third and fourth pairs of tines is separated from an adjacent pair of tines by a distance $d_1$, and d is greater than $d_1$;

d) a pair of side tines, each of said pair of side tines connected to one of a pair of cylinders which can be actuated to move each of said pair of side tines separately towards or away from one another, one of said pair of side tines being positioned adjacent to said first end of said second rail and said other of said pair of side tines being positioned adjacent to said second end of said second rail;

e) a pair of hoses for supplying pressurized fluid or air between said motorized vehicle and each of said pair of cylinders, and said pressurized fluid or air actuates said pair of cylinders;

f) a first chain saw, a second chain saw, and a third chain saw, each of said first, second and third chain saws pivotably mounted to said frame, said first chain saw positioned between said first and second pairs of tines, said second chain saw positioned between said third and fourth pairs of tines, and said third chain saw positioned between said second and third pairs of tines, each of said first, second and third chain saws being electrically started, and each of said first, second and third chain saws being operated by pressurized fluid or air from said motorized vehicle;

g) a plurality of bumpers formed from metal, each of said bumpers positioned between two individual tines which makeup each of said first, second, third and fourth pairs of tines, each of said bumpers movably secured to said vertical portions of each of said first, second, third and fourth pairs of said tines, each of said bumpers being spaced apart from an adjacent bumper, and said first, second, third and fourth pairs of tines can be maneuvered to pickup from between one to six logs at a time and raise said logs a desired distance above the ground, and said pair of side tines can longitudinally align said logs relative to one another so that they can be cut to a desired length; and h) a pair of grappling members each having an arcuate member, and each pivotably mounted to said frame, said pair of grappling members positioned above said second and third pairs of tines, and each of said pair of grappling members functioning to retain said logs on said first, second, third and fourth pairs of tines.

11. The pickup and alignment mechanism of claim 10 wherein each of said pair of grappling members includes a cylinder having a piston rod, a first linkage connecting said piston rod to a portion of said arcuate member, and a second linkage connecting an opposite end of said cylinder to said frame.

12. The pickup and alignment mechanism of claim 10 wherein each of said pair of grappling members is located on either side of said third chain saw.

13. The pickup and alignment mechanism of claim 10 wherein each of said pair of grappling members can move independent of one another.

14. The pickup and alignment mechanism of claim 10 wherein each of said bumpers is formed from a metal alloy, and each of said first, second and third chain saws are operated sequentially.

15. The pickup and alignment mechanism of claim 10 wherein said pair of grappling members can move as a unit.

16. A pickup, alignment and cutting mechanism capable of being attached to a motorized vehicle, comprising:

a) a frame including a first rail, a second rail and a face plate, said first rail being spaced apart from said second rail, said first and second rails each having a first end and a second end, said face plate connecting said first rail to said second rail, and said face plate having an upper edge positioned adjacent to said first rail and a lower edge positioned adjacent to said second rail;

b) a connector secured to said face plate which allows said pickup and attachment mechanism to be attached to said motorized vehicle, said connector including a first abutment point located adjacent to said upper edge of said face plate, second and third spaced apart attachment points located adjacent to said lower edge of said face plate, and said first abutment point being located approximately midway between said second and third attachment points;

c) a first pair, a second pair, a third pair, a fourth pair, and a fifth pair of tines, each of said first, second, third, fourth, and fifth pair of tines comprising two individual tines, each of said individual tines being an integral member having an L-shaped configuration which includes a horizontal portion aligned approximately perpendicular to a vertical portion, and each vertical portion being movably secured to both said first and second rails such that each of said individual tines can be moved along the length of said first and second rails;

d) a first chain saw, a second chain saw, a third chain saw, and a fourth chain saw each pivotably mounted to said frame, said first chain saw positioned between said first and second pairs of tines, said second chain saw positioned between said fourth and fifth pairs of tines, said third chain saw positioned between said second and third pairs of tines, and said fourth chain saw positioned between said third and fourth pair of tines, each of said first, second, third and fourth chain saws being electrically started, and each of said first, second, third and fourth chain saws being operated by pressurized fluid or air from said motorized vehicle;

e) a pair of side tines, each of said pair of side tines connected to one of a pair of cylinders which can be actuated to move each of said pair of side tines separately towards or away from one another, one of said pair of side tines being positioned adjacent to said first end of said second rail and said other of said pair of side tines being positioned adjacent to said second end of said second rail;

f) a pair of hoses for supplying pressurized fluid or air between said motorized vehicle and said pair of cylinders, and said pressurized fluid or air actuates said pair of cylinders;

g) a plurality of bumpers formed from wood, each of said bumpers positioned between two individual tines which makeup each of said first, second, third, fourth and fifth pairs of tines, each of said bumpers movably secured to said vertical portions of each of said first, second, third, fourth and fifth pairs of tines by a mechanical fastener, each of said bumpers being spaced apart from an adjacent bumper, each of said bumpers providing clearance so that each of said first, second, third and fourth chain saws can completely cut through each of said logs resting on said first, second, third, fourth and fifth pairs of tines, and said first, second, third, fourth and fifth pairs of tines can be maneuvered to pickup from between one to six logs at a time and raise said logs a desired distance above the ground, and said pair of side tines can longitudinally align said logs relative to one another so that they can be cut to a desired length by said first, second, third and fourth chain saws, and said first, second, third and fourth chain saws being sequentially operated such that said first chain saw will make a cut through each of said logs resting on said first, second, third, fourth and fifth pairs of tines, said second chain saw will then make a cut through each of said logs positioned on said first, second, third, fourth and fifth pairs of tines, said third chain saw will make a cut through each of said logs positioned on said first, second, third, fourth and fifth pairs of tines, and said fourth chain saw will make a cut through each of said logs positioned on said first, second, third, fourth and fifth pairs of tines; and h) a grappling member having an arcuate member which is pivotably mounted to said frame, said grappling member positioned between said third and fourth chain saws, and said grappling member functioning to retain said logs in an approximate three-sided polygon configuration on said first, second, third, fourth and fifth pairs of tines.

17. The pickup and alignment mechanism of claim 16 wherein each of said first, second, third and fourth chain saws are operated sequentially, and wherein each of said pair of side tines has a vertical extension to assist in keeping said logs aligned.

18. The pickup and alignment mechanism of claim 16 wherein said grappling member includes a cylinder having a piston rod, a first linkage connecting said piston rod to a portion of said arcuate member, and a second linkage connecting an opposite end of said cylinder to said frame, and said grappling member moving between an open and a closed position.

19. The pickup and alignment mechanism of claim 16 wherein said frame includes a movable center member on which said third pair of tines is secured, and said movable center member can be raised relative to said frame which will cause logs positioned on said third pair of tines to sag at their end, and this will limit said logs from binding against said third and fourth chain saw blades as cuts are being made.

20. A method of using the pickup and alignment mechanism of claim 1 comprising the steps of:

a) removably mounting said pickup and alignment mechanism to a motorized vehicle and fluidly connecting said pickup and attachment mechanism to a hydraulic or pneumatic system present on said motorized vehicle;

b) starting said motorized vehicle to pressurize said hydraulic or pneumatic system;

c) engaging a pile of cut logs, each log having a length of approximately 100 inches, with said first, second, third, fourth and fifth pairs of tines, and removing from one to six logs from said pile;

d) aligning said logs approximately parallel to one another on said first, second, third, fourth and fifth pairs of tines when more than one log is present;

e) arranging said logs in a single row on said first, second, third, fourth and fifth pairs of tines when more than one log is present;

f) moving each of said pair of side tines separately to align the ends of said logs relative to one another when more than one log is present; and g) raising said one to six logs above ground level to a desired height, and cutting said logs into smaller pieces using a chain saw.

* * * * *